US007175538B2

(12) United States Patent
Miller

(10) Patent No.: US 7,175,538 B2
(45) Date of Patent: Feb. 13, 2007

(54) GOLF CLUB GRIP

(76) Inventor: R. Lee Miller, 1 Lower Ragsdale Dr., Bldg. 3, Suite 700, Monterey, CA (US) 93940

( * ) Notice: Subject to any disclaimer, the term of this patent is extended or adjusted under 35 U.S.C. 154(b) by 0 days.

(21) Appl. No.: 10/783,011

(22) Filed: Feb. 23, 2004

(65) Prior Publication Data

US 2005/0187030 A1 Aug. 25, 2005

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS 3,706,453 A * 12/1972 Rosasco, Jr. ..... 473/203
3,837,647 A * 9/1974 Jacques ..... 473/300
5,058,891 A * 10/1991 Takeuchi ..... 473/201
5,906,548 A * 5/1999 Hadge ..... 473/206
2003/0228929 A1* 12/2003 Miyasu et al. ..... 473/300

FOREIGN PATENT DOCUMENTS

JP 2001-46568 * 2/2001

* cited by examiner

*Primary Examiner*—Stephen Blau
(74) *Attorney, Agent, or Firm*—Law Offices of J.D. Geraigery, P.C.; Janice D. Geraigery

(57) ABSTRACT

A golf club grip being axially coupled about the end of a golf club shaft. The diameter of the golf club grip is progressively reduced from the interface between the golf club grip and the golf club shaft to the opposing cap end of the golf club grip. The external surface of the golf club grip is extended upwardly into an elevated, linear ridge which extends from the interface between the golf club grip and the golf club shaft to the opposing end of the golf club grip along the axis of the club shaft. The elevated ridge provides the basis for consistent positioning of the grip in the user's hand.

8 Claims, 2 Drawing Sheets

GOLF CLUB GRIP

BACKGROUND OF THE INVENTION

1. Field of the Invention

The present invention generally relates to golf clubs and, more particularly, to a golf club grip having a non-uniform configuration.

2. Prior Art

It is well recognized that, to successfully play the game of golf, it is necessary for the player to impose his or her control over the shaft and head of the golf club during the swing. It is also well recognized that it is the golfer's use of the fingers and palm of each hand is essential in achieving golf control and feel. How the golfer uses the fingers and palm of the hands in controlling the club and the type of such control required varies for the swing utilized from club to club.

Proper control over a golf club will dictate the flight of the ball when struck by the club. If the face of the golf club does not contact the ball properly, the flight of the ball will be diverted from the intended direction. Most recreational golfers, even while note having physical difficulty with grasping and holding a conventional golf club, do not have sufficient skill or coordination to strike the golf ball on a consistent basis. The recreational golfer therefore often hooks or slices the ball as opposed to hitting the ball in the intended direction.

One of the problems inherent in the conventional construction of golf clubs is the substantially uniform construction of golf club grips. A conventional golf club grip has an external surface which, when mounted on the shaft of a golf club, has a generally cylindrical configuration with the diameter of the grip decreasing substantially uniformly from the cap end of the grip to the shaft end of the grip. For a right handed golfer, the right hand is placed below the left hand and is substantially adjacent the shaft end of the grip. In a conventional golf club grip, the diameter of the shaft end of the grip is less than the diameter of the grip at the cap end of the grip. As a general rule, the right hand of a right handed golfer provides most of the power when the golf club strikes the ball. However, the problems with conventional golf club grips is inherent in their design.

In conventional grips used on substantially all golf club sets, the golf club grip decreases in diameter from the cap end of the grip to the shaft end of the grip. The reduced grip diameter at the shaft and may result in the golfer having less control over the alignment of the club when it strikes the ball. The present invention overcomes the problems inherent in conventional golf grips by providing a golf club grip which has a greater diameter at the shaft end of the grip and a reduced diameter at the cap end thereof and an axially positioned, linear ridge disposed along the outer surface of the golf club grip to provide consistent positioning of the grip in the user's hand.

The prior art discloses a design for a golf club grip which employs a truncated conical shape whose larger base is at the sleeve end closest to the golf club end of the shaft and whose smaller base is adjacent the free end of the shaft. However, this design fails to incorporate any means for providing consistently positioning the golf club grip in the user's hand.

Another design for a golf club grip disclosed by the prior art substantially increases the diameter of the grip at the cap end thereof as opposed to the diameter of the grip at the shaft end of the grip. The large diameter of the grip at the cap end purportedly provides more angular control over the club face. The problems created by this design are even greater than those inherent in conventional shaft grips. As a result of the substantially greater diameter of the cap end of the grip, the ability of the golfer to hold the club and maintain control over it is even lessened thereby degrading the control the golfer has over his or her golf swing.

The present invention substantially resolves the problems inherent in the golf club grip designs disclosed by the prior art. The present invention golf club grip is axially mounted upon the golf club shaft. The portion of the grip at the shaft end has a diameter which is greater than the diameter of the grip at the cap end thereof. To insure for consistent positioning of the grip in the hands of the user, the outer surface of the grip has an elevated ridge in axial alignment with the axis of the golf club shaft extending from the shaft end of the grip to the cap end of the grip. The elevated ridge is adapted to be placed adjacent the interface between the palm and fingers of each of the user's hands. Since the right hand of a right handed golfer is enclosed around the grip at the shaft end thereof, the increased diameter prevents the golfer from gripping the club too tightly and thereby enhances the control of the golfer over the golf swing.

SUMMARY OF THE INVENTION

The present invention provides an improved golf club grip which enhances the control, accuracy, hitting power and distance in the use of the golf club. The improved golf club grip is coupled to an end of a golf club shaft. The outer surface of the present invention golf club grip is defined by a frustoconical surface, the ends thereof being defined as the shaft end and the cap end. The diameter of the present invention grip at the shaft end thereof is greater than the diameter of the grip at the cap end. The diameter of the present invention grip progressively decreases from the shaft end of the grip to the cap end of the grip. To provide improved control, the present invention provides means for consistent positioning of the golf club grip in the hands of the user. The outer surface of the golf club grip is elevated into a linear ridge from the shaft end to the cap end of the grip. When placed in the hand of the user, the elevated ridge is sensed by the user and will be positioned consistently in the proper location in the hands of the user.

It is therefore an object of the present invention to provide an improved grip for a golf club.

It is another object of the present invention to provide a grip for a golf club which provides for increased control of the swing of the golf club.

It is still yet another object of the present invention to provide an improved golf club grip which is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENT PREFERRED EMBODIMENT

Figure 1:
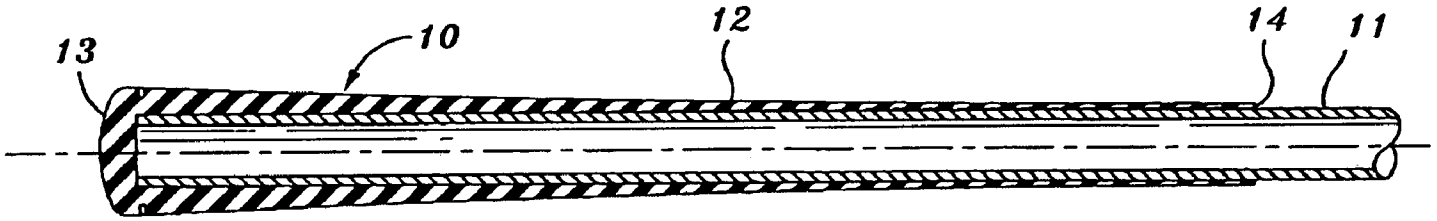
Fig. 1 (PRIOR ART)
FIG. 1 illustrates a conventional golf club grip in accordance with the prior art.
Figure 2:
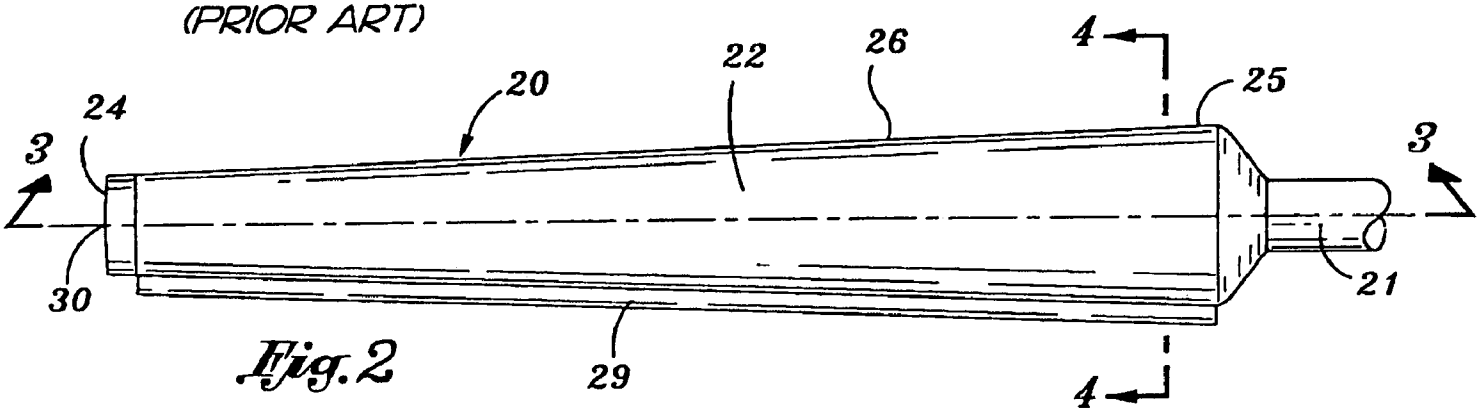
FIG. 2 illustrates a side elevation view of the present invention golf club grip.
Figure 3:
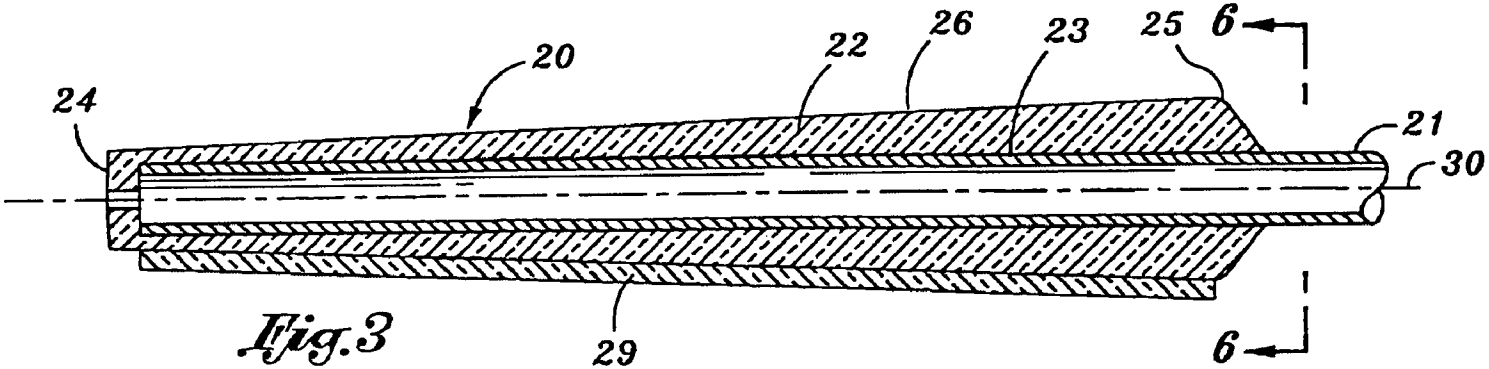
FIG. 3 illustrates a cross-sectional, side elevation view of the golf club grip shown in FIG. 2 taken through line 3—3 of FIG. 2.
Figure 6:
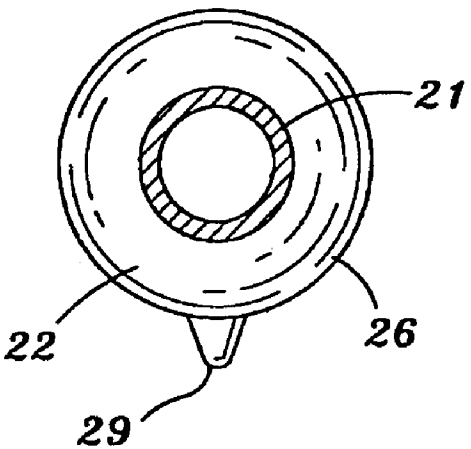
FIG. 6 illustrates a partial, cross-sectional view of the present invention golf club grip taken through line 6—6 of FIG. 3.
Figure 5:
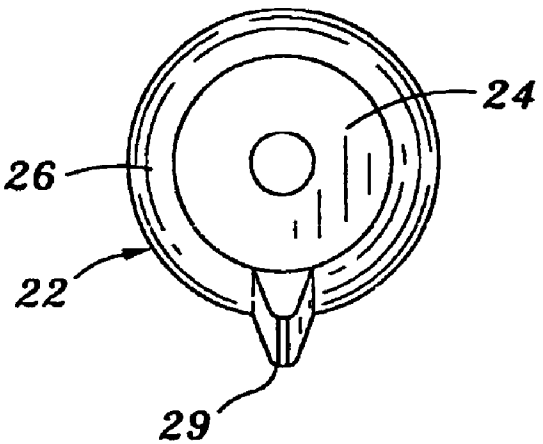
FIG. 5 illustrates the cap end view of the present invention golf club grip shown in FIG. 2.
Figure 4:
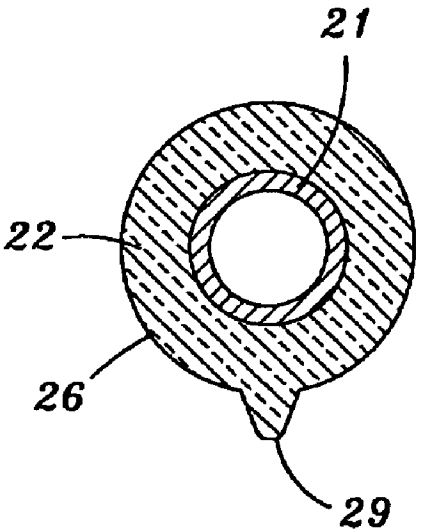
FIG. 4 illustrates a cross-sectional view of the golf club grip shown in FIG. 2 taken through line 4—4 of FIG. 2.

An understanding of the present invention can be best gained by reference to FIGS. 2 and 6, inclusive. As shown in FIG. 1, a conventional golf club 10 employs a standard shaft 11 which is typically circular in circumference. A grip 12 is mounted upon the end of the shaft opposite the club head (not shown). Grip 12 is typically constructed or molded of a rubber compound and has an internal diameter slightly smaller than the external diameter of the shaft 11. The grip 12 has a cap end 13 and a shaft end 14. The grip 12 has a diameter at the cap end which is larger than the diameter of the grip at the shaft end 14.

The present invention comprises an improved golf club grip which is designated by the reference numeral 20. Although grip 20 is described with respect to its use in combination with a conventional cylindrical shaft 21, it is understood that golf club shafts having different configurations can be used in combination with the present invention grip 20. Grip 20 consists of a molded rubber, plastic or like formed grip body 22 which is disposed about the outer cylindrical surface 23 of shaft 21. The outer surface 23 of grip body 22 comprises a frustoconical configuration having a reduced diameter at the cap end 24 of grip 20 and a larger diameter 25 at the shaft end thereof. The inner surface of grip body 22 is substantially cylindrical and has a diameter which is slightly less than the outer diameter of shaft 21.

The reduction gradient in the diameter of outer surface 26 of grip body 22 from shaft end 25 to cap end 24 is uniform along the axial distance from shaft end 25 to cap end 24. In the preferred embodiment of the present invention, the diameter of grip body 22 at shaft end 25 is within the range of 0.92"–0.95" and the diameter of grip body 22 at cap end 24 is in the range of 0.77"–0.80". It is understood by persons having skill in the art that the diameter of body grip 22 at cap end 24 and shaft end 25 thereof may be altered to adapt to the physical size of the user. However, the diameter of body grip 22 at shaft end 25 is always larger than the diameter at cap end 24.

As stated, it is an objective of the present invention to provide a golf club grip which improves the control which a golfer has over a golf club. Proper control over the golf club will dictate the flight of the ball when struck by the club. As a general rule, the right hand of a right handed golfer provides most of the power when the golf club strikes the ball. The hand of the user placed closest to the shaft end 25 of the grip (i.e., the right hand of a right handed golfer) provides most of the power when the golf club strikes the ball. With a golf club grip constructed in connection with the present invention, the right hand of the golfer will be secured about the portion of the outer surface 26 of grip body 22 adjacent shaft end 25. The upper hand of the user will be secured about grip body 22 of grip 20 adjacent cap end 24.

The objectives of the present invention can be met only if grip 20 can be consistently positioned in the hands of the user in order to insure the club head properly addresses the ball. To meet this objective, the outer surface 26 of grip body 22 is elevated into a ridge 29 which extends longitudinally from the shaft end 25 of grip body 22 to cap end 24 of grip 22. Ridge 29 is in longitudinal alignment with axis 30 of shaft 21 and is adapted to be in contact with the interface between the user's palm and hands when the user is holding the grip body 22.

In the preferred embodiment of the present invention, ridge 29 forms a substantially triangular structure relative to outer surface 26. However, it is understood by persons having skill in the art that ridge 29 can be of varied geometrical shapes so long as the apex of the ridge 29 can be easily differentiated from outer surface 26. Ridge 29 is aligned with the head of the club so that, when positioned in the interface between the user's fingers and palm of each hand, the head of the club (not shown) will properly address the ball. It is understood that, although the preferred embodiment of the present invention employs an elevated ridge 29 which extends the full extent of grip body 22 between cap end 24 and shaft end 25, ridge 29 can be truncated and be omitted from that portion of grip body 22 not held by the user.

The present invention provides an improved golf club grip body 22 which enhances the ability of a user to control his or her swing and thereby control of the flight of the ball struck by the head of the golf club. To provide this control, the present invention grip body 22 has a larger diameter at the shaft end 25 of the grip as opposed to the cap end 24 and employed an elevated ridge 29 to insure the grip is consistently positioned in the hands of the user. To insure the user is able to consistently position grip body 22 in his or her hands, longitudinal ridge 29 extends through the area where grip body 22 is held and is sufficiently elevated from surface 26 to provide contact at the interface between the fingers and palms of the hands of the user.

I claim:

1. An improved golf club grip to be mounted on a shaft comprising:

an elongated grip body formed of moldable resilient material;

a cap end;

a shaft end;

a longitudinal axis;

an external surface having a substantially circular cross-sectional configuration throughout the length of said body and said external surface having a first diameter adjacent to said shaft end and a second diameter adjacent to said cap end;

an elongated substantially circular cavity disposed through said shaft end coaxially through said longitudinal axis of said grip body and adapted to receive the golf club shaft;

a progressively and uniformly decreasing external diameter from said first diameter to said second diameter; and an integrally formed alignment means for positioning said grip body in the hands of a user, said alignment means extending upwardly from the exterior surface of said grip body in alignment with the longitudinal axis of the golf club shaft and adapted in cooperation with the decreasing diameter of said grip body from said shaft end to said cap end of said grip body whereby the grip body adjacent to the shaft end provides an improved grip for the hands of the user and better control of the golf club.

2. An improved golf club grip as defined in claim 1 wherein said first diameter is approximately in the range of 0.92"–0.95" and said second diameter is approximately in the range of 0.77"–0.80".

3. An improved golf club grip as defined in claim 2 wherein the diameter of said grip body uniformly decreases from the shaft end to the cap end of said grip body.

4. An improved golf club grip as defined in claim 1 wherein said alignment means comprises an elongated ridge depending upwardly from the external surface of said body in alignment with the longitudinal axis of said grip body.

5. An improved golf club grip as defined in claim 4 wherein said elongated ridge extends from the cap end to the shaft end of said grip body.

6. An improved golf club grip adapted to be coupled to an elongated golf club shaft having a longitudinal axis, said golf club grip comprising:

an elongated grip body formed of moldable resilient material;

a cap end;

a shaft end;

a longitudinal axis;

an external surface having a substantially circular cross-sectional configuration throughout the length of said body and said external surface having a first diameter adjacent to said shaft end and a second diameter adjacent to said cap end;

an elongated substantially circular cavity disposed through said shaft end coaxially through said longitudinal axis of said grip body and adapted to receive the golf club shaft;

a progressively and uniformly decreasing external diameter from said first diameter to said second diameter; and an integrally formed alignment ridge extending upwardly from the external surface of said grip body in alignment with the longitudinal axis of said golf club shaft and adapted in cooperation with the decreasing diameter of the grip body from the shaft end to the cap end so as to permit the golf club grip to be consistently positioned in the hands of the user for better control of the golf club.

7. An improved golf club grip as defined in claim 6 wherein said first diameter is approximately in the range of 0.92"–0.95" and said second diameter is approximately in the range of 0.77"–0.80".

8. An improved golf club grip as defined in claim 6 wherein said elongated ridge extends from the cap end to the shaft end of said grip body.

* * * * *